US005079865A

United States Patent [19]

Hutson

[11] Patent Number: 5,079,865

[45] Date of Patent: Jan. 14, 1992

[54] SNOW REMOVAL APPARATUS

[76] Inventor: Bennie L. Hutson, R.R. 3 Box 161B, Windsor, Mo. 65360

[21] Appl. No.: 594,444

[22] Filed: Oct. 5, 1990

[51] Int. Cl.[5] ..... E01H 5/07; E01H 5/10

[52] U.S. Cl. ..... 37/229; 37/238; 37/254; 126/271.1; 126/343.5 R

[58] Field of Search ..... 37/249, 250, 251, 254, 37/255, 256, 257, 226, 227, 228, 229, 238, 239; 126/343.5 R, 271.1, 271.2 A, 271.2 R

[56] References Cited

U.S. PATENT DOCUMENTS

| | | | |
|---|---|---|---|
| 1,698,196 | 1/1929 | Lang | 126/271.1 |
| 2,225,207 | 12/1940 | Cluff | 126/271.1 |
| 3,066,428 | 12/1962 | Raiti | 37/250 X |
| 3,140,707 | 7/1964 | Spinelli | 37/227 X |
| 3,484,961 | 12/1969 | Coslowsky | 37/227 |
| 4,785,561 | 11/1988 | Swanson | 37/228 X |

FOREIGN PATENT DOCUMENTS

| | | | |
|---|---|---|---|
| 632796 | 11/1978 | U.S.S.R. | 37/227 |

*Primary Examiner*—David H. Corbin
*Assistant Examiner*—Arlen L. Olsen
*Attorney, Agent, or Firm*—Leon Gilden

[57] ABSTRACT

Apparatus defined by an elongate truck body with a cab and truck bed housing overlying elongate truck frame plate. A forwardly oriented chute with an impeller drive at a forwardmost end of the chute directs snow upwardly through the chute by use of a drive belt into a receiving tank. The receiving tank includes a plurality of heater plates arranged in an angular relationship overlying the tank adjacent the uppermost end of the drive belt. The truck bed includes an auxiliary pump for directing fluid outwardly relative to the tank and further includes a drive motor for driving a generator to operate the heater plates, auxiliary pump, and heater unit positioned rearwardly within the truck bed housing with the heater unit underlying an apertured floor of the truck frame plate to direct heat therethrough to effect completion of snow removal underlying the truck body during its traverse over a road surface to be cleared of snow.

2 Claims, 4 Drawing Sheets

PRIOR ART

SNOW REMOVAL APPARATUS

BACKGROUND OF THE INVENTION

1. Field of the Invention

The field of the invention relates to snow removal apparatus, and more particularly pertains to a new and improved snow removal apparatus wherein the same sets forth a self contained operative unit to effect simultaneous removal, melting, and storage of snow as well as a further unit to effect a melting and drying procedure rearwardly of the truck body.

2. Description of the Prior Art

Various snow removal apparatus has been utilized in the prior art to effect snow removal in climates requiring such activity. Such apparatus may be found in U.S. Pat. No. 3,304,632 to KOTLAR et al wherein a snow removal and melting organization is provided with a fully oriented snow removing impeller directed rearwardly of the truck body to a receiving tank.

U.S. Pat. No. 4,071,966 to COHEN sets forth an apparatus for removing snow wherein a forwardly oriented chute is positioned forwardly of a truck to direct snow rearwardly into a holding tank of the truck wherein a torch member is directed at the snow to effect melting thereof.

U.S. Pat. No. 4,785,561 to SWANSON sets forth a snow removal organization wherein a heater unit directs heat to project such heat at incoming snow from a snow removal organization mounted to a truck member.

U.S. Pat. No. 4,353,176 to HESS and U.S. Pat. No. 4,615,129 to JACKSON are further examples of snow removal apparatus utilizing various conveyor means to direct snow to storage tanks within mobile units to traverse a road surface.

As such, it may be appreciated that there continues to be a need for a new and improved snow removal apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of snow removal apparatus present in the prior art, the present invention provides a new and improved snow removal apparatus wherein the same provides a self propelled vehicle to effectively and efficiently melt and contain snow of a roadway and to further effect a melting and drying of the roadway during traverse of the vehicle thereover. As such, the general purpose of the present invention, which will be described subsequently in greater detail, is to provide a new and improved snow removal apparatus which has all the advantages of the prior art snow removal apparatus and none of the disadvantages.

To attain this, the snow removal apparatus of the instant invention includes apparatus defined by an elongate truck body with a cab and truck bed housing overlying elongate truck frame plate. A forwardly oriented chute with an impeller drive at a forward-most end of the chute directs snow upwardly through the chute by use of a drive belt into a receiving tank. The receiving tank includes a plurality of heater plates arranged in an angular relationship overlying the tank adjacent the upper-most end of the drive belt. The truck bed includes an auxiliary pump for directing fluid outwardly relative to the tank and further includes a drive motor for driving a generator to operate the heater plates, auxiliary pump, and heater unit positioned rearwardly within the truck bed housing with the heater unit underlying an apertured floor of the truck frame plate to direct heat therethrough to effect completion of snow removal underlying the truck body during its traverse over a road surface to be cleared of snow.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved snow removal apparatus which has all the advantages of the prior art snow removal apparatus and none of the disadvantages.

It is another object of the present invention to provide a new and improved snow removal apparatus which may be easily and efficiently manufactured and marketed.

It is a further object of the present invention to provide a new and improved snow removal apparatus which is of a durable and reliable construction.

An even further object of the present invention is to provide a new and improved snow removal apparatus which is susceptible of a low cost of manufacture with regard to both materials and labor, and which accordingly is then susceptible of low prices of sale to the consuming public, thereby making such snow removal apparatus economically available to the buying public.

Still yet another object of the present invention is to provide a new and improved snow removal apparatus which provides in the apparatuses and methods of the prior art some of the advantages thereof, while simultaneously overcoming some of the disadvantages normally associated therewith.

Still another object of the present invention is to provide a new and improved snow removal apparatus which may be compactly stored when not being utilized.

Yet another object of the present invention is to provide a new and improved snow removal apparatus wherein the same directs a self propelled vehicle to traverse a roadway and effect a clearing of the roadway of snow and ice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
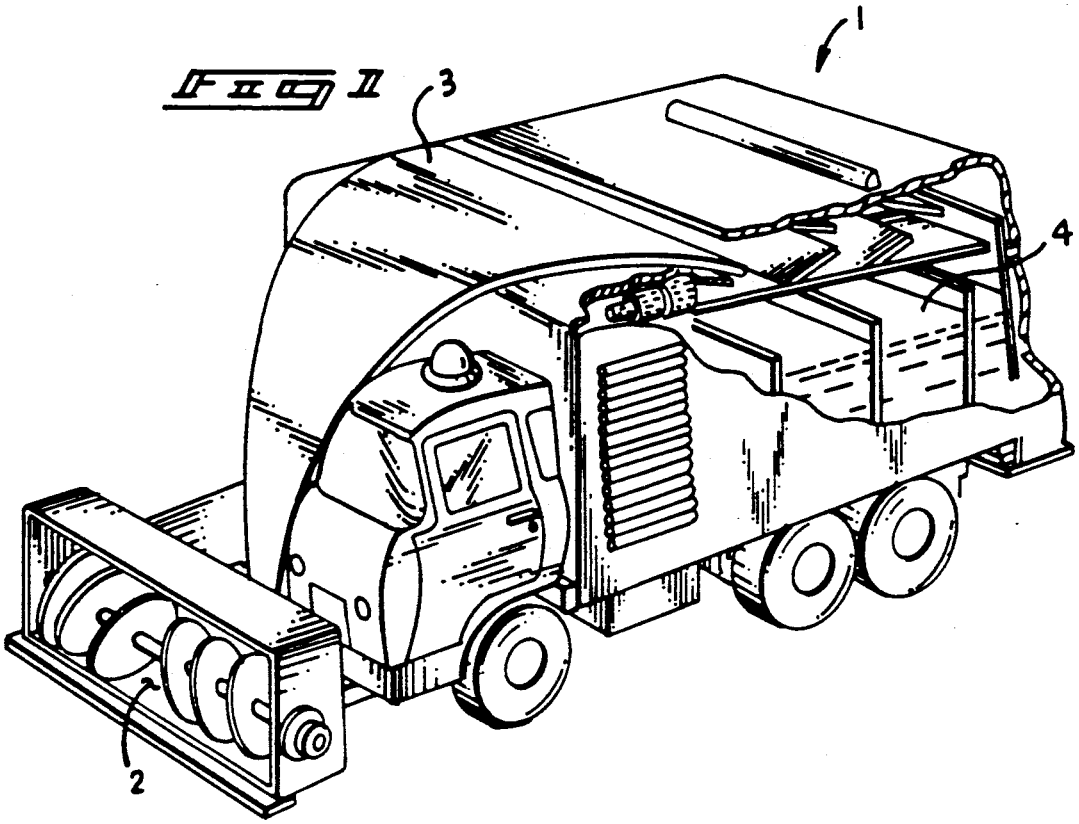
FIG. 1 is an isometric illustration of a prior art snow removal apparatus.

With reference now to the drawings, and in particular to FIGS. 1 to 6 thereof, a new and improved snow removal apparatus embodying the principles and concepts of the present invention and generally designated by the reference numeral 10 will be described.

Figure 2:
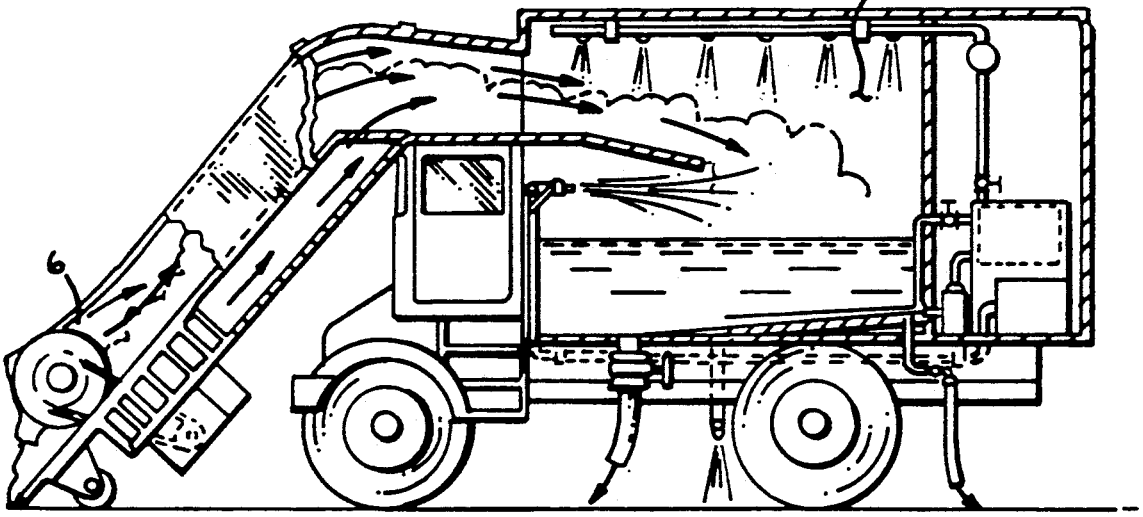
PRIOR ART FIG 2
FIG. 2 is an orthographic side view partially in section of a further example of a snow removal apparatus.
Figure 3:
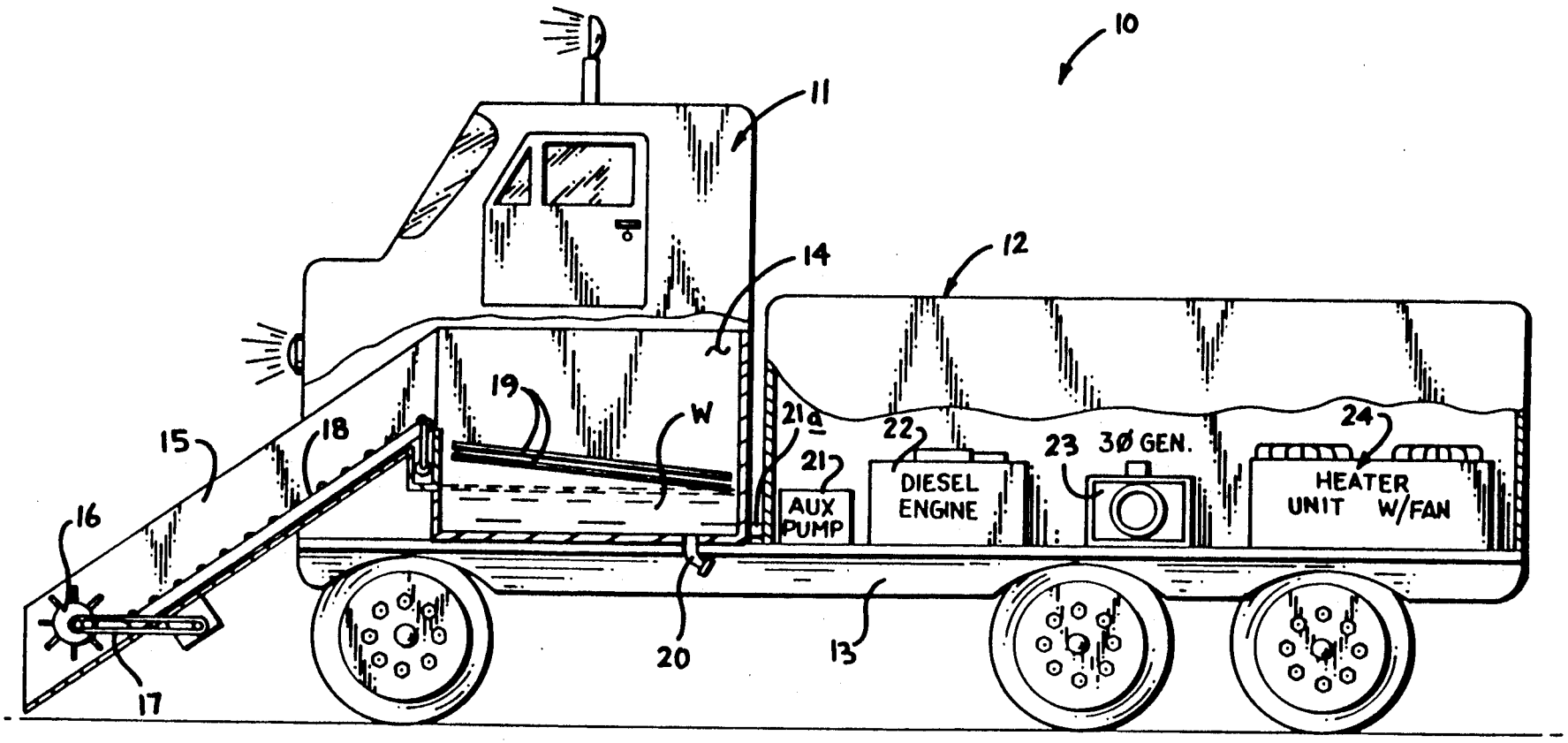
FIG. 3 is an isometric illustration partially in section of the instant invention.
Figure 4:
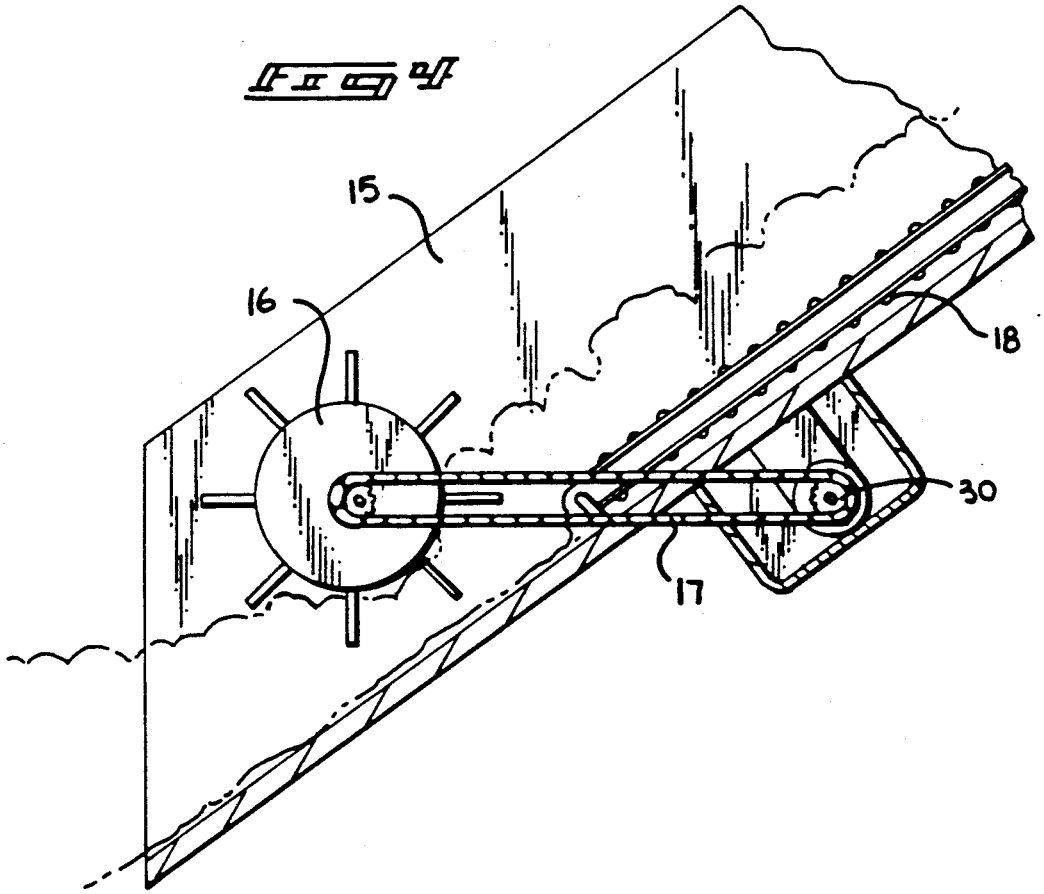
FIG. 4 is an orthographic cross-sectional illustration of the conveyor chute utilized by the instant invention.

FIG. 1 illustrates a prior art snow removal apparatus as typified by U.S. Pat. No. 3,304,632 wherein a unit 1 includes a forwardly oriented impeller organization 2 to direct snow through a chute overlying a storage tank 4 including a series of baffles therewithin to minimize turbulence and splashing of the fluid within the tank. FIG. 2 illustrates a further prior art snow removal apparatus as set forth in U.S. Pat. No. 4,071,966 wherein a unit 5 includes a forwardly oriented impeller 6 to direct snow through the chute overlying the truck cab wherein a torch 7 melts the snow and permits securement of the resultant fluid within a storage tank.

More specifically, the snow removal apparatus 10 of the instant invention essentially comprises a truck assembly including a truck cab 11 positioned forwardly of a truck bed housing 12 wherein the cab and housing 11 and 12 respectively overlie and are integrally mounted to a frame plate 13. It is understood that the truck assembly is of a typical self propelled organization wherein detail as to the engine and drive mechanism the knowledge is understood in the art.

Figure 6:
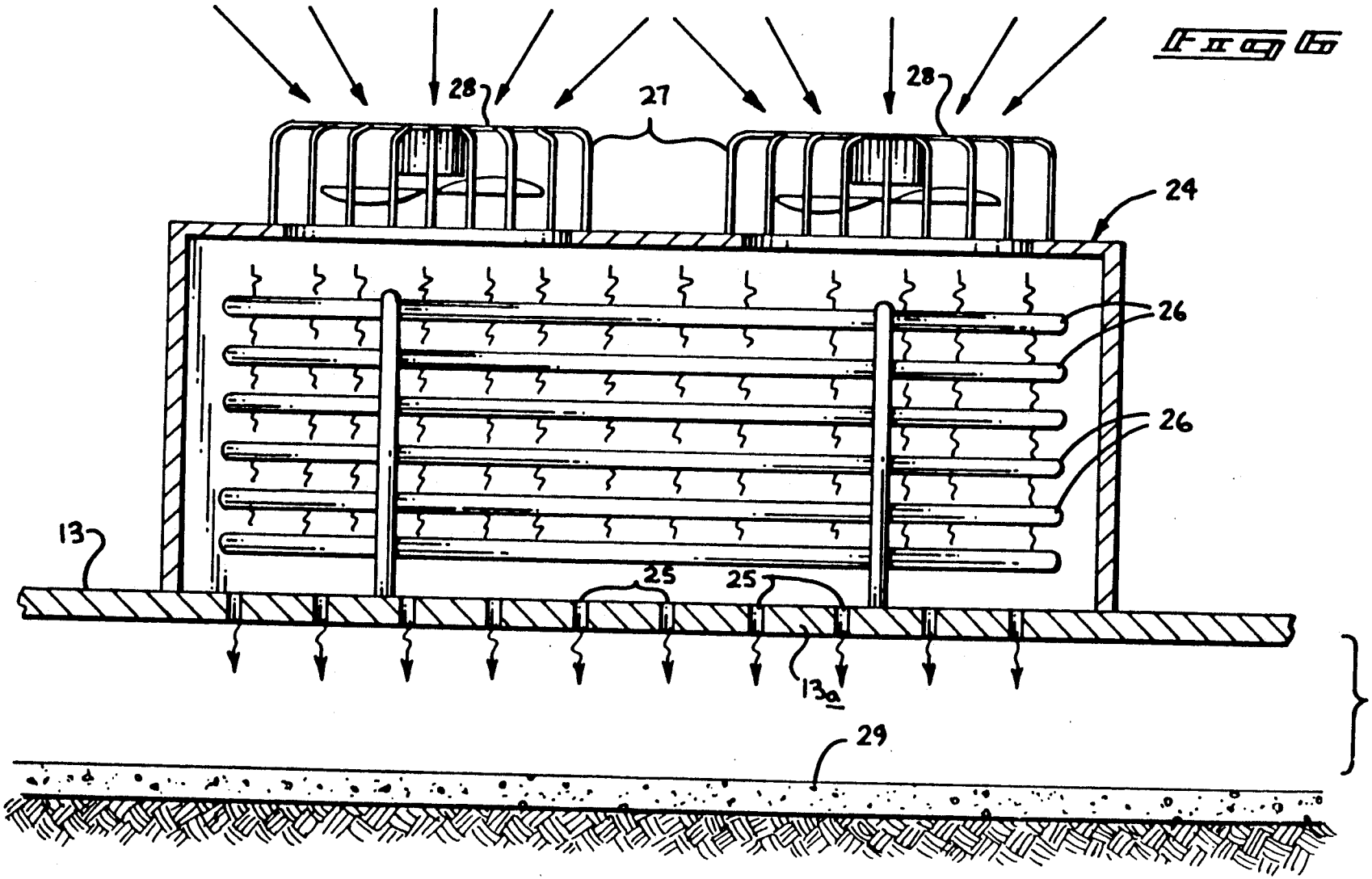
FIG. 6 is an orthographic cross-sectional illustration of the heating and drying means utilized by the instant invention.

The truck cab 11 includes a receiver tank 14 underlying a vehicle operator cavity within the cab wherein the tank 14 is in communication with an upper terminal end of a chute 15. The lower-most end of the chute 15 angulated downwardly relative to the receiver tank 14 includes an impeller drive 16 mounted at a lower-most end thereof of a type as typified and incorporated herein by reference in U.S. Pat. Nos. 3,304,632 and 4,071,966. A drive belt 17 cooperative with a first drive motor 30 (see FIG. 4) directs rotation of the impeller drive 16. A cogged conveyor belt 18 including a series of parallel spaced transverse projections mounted to the top surface of the endless conveyor 18 defines a predetermined flite with a lower-most end positioned adjacent the drive belt 17 with an upper terminal end positioned adjacent the upper terminal end of the chute 15. The conveyor belt 18 is arranged parallel to the floor of the chute in orientation to direct snow accumulated by the impeller drive 16 upwardly through the chute 15 and into the receiver tank 14. A series of first heater plates 19 are positioned within the receiver tank 14 and are oriented in a stacked and inclined orientation wherein the individual plates are arranged parallel relative to one another with the plates defining a downwardly slopping angle relative to the tank to effect directing of the snow and fluid into the tank during use. The first gear plates 19 include a forward terminal end arranged adjacent the conveyor belt 18 with a lower terminal end oriented downwardly relative to the forward terminal end. The receiver tank 14 includes a drain pipe and removable cap 20 directed through the floor of the receiver tank 14 to permit drainage of the fluid and water W within the tank as desired. An auxiliary pump 21 mounted within the truck bed housing 12 and operative independently or through a power unit 22 such as a diesel engine permits pumping of the water W into a storage tank or into subsequent disposal subsequent to storage of the water W within the receiver tank 14. Further, a generator 23 is provided operative through the power unit 22 to direct energy selectively to the first heater plates 19, the auxiliary pump 21, and the heater assembly 24. Reference to FIG. 6 illustrates the heater assembly 24 that overlies a rear portion of the truck frame plate 13 defined as an apertured floor 13*a*. The apertured floor 13*a* positioned rearwardly of the truck bed housing 12 at a rear terminal end of the truck assembly. This organization includes a housing enclosing a series of second stacked heater plates 26 arranged parallel relative to one another and underlying a plurality of fan assemblies and impellers 28 protected by a surrounding fan housing 27 surrounding each fan assembly 28. The fan assemblies 28 direct air downwardly past the second heater plates 26 to direct heat through the apertures 25 of the apertured floor 13*a* to direct heat to an underlying road surface 29 upon traverse of the truck assembly thereover. This heat enhances final melting and drying of the road surface 29.

Figure 5:
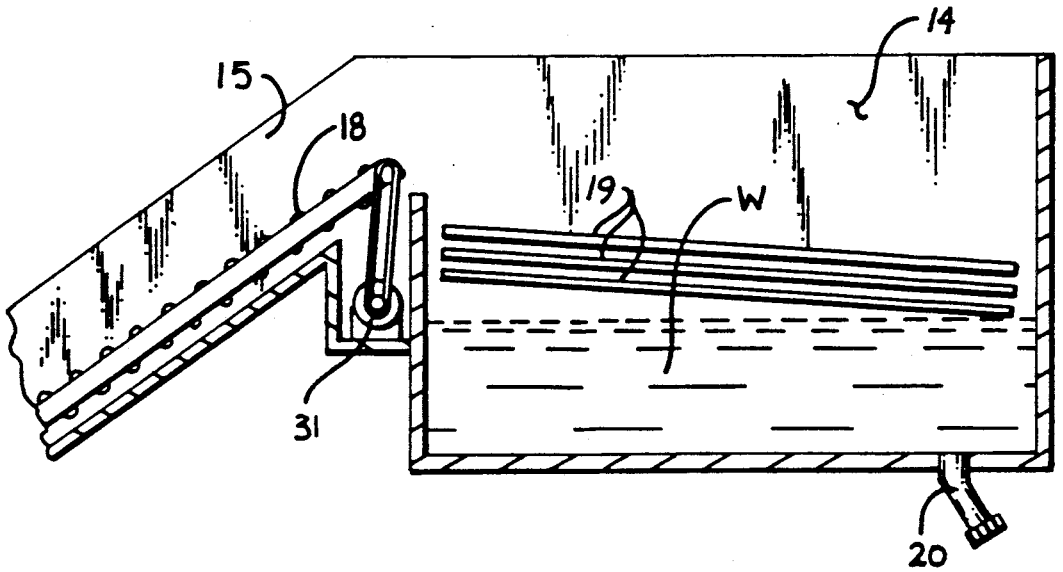
FIG. 5 is an orthographic cross-sectional illustration of the receiver tank of the instant invention.

It is understood further that the generator 23 effects energy to the first drive motor 30 directing rotation of the impeller drive 16 as well as to a second drive motor 31 effecting operation of the conveyor belt 18 as illustrated in FIG. 5 for example.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A snow removal apparatus for removing snow and ice from a roadway comprising a wheeled vehicle, and the vehicle including a truck cab and a truck bed housing positioned rearwardly of the truck cab with the truck cab and truck bed housing overlying a truck frame plate, and a receiver tank positioned within the truck cab, and an elongate chute projecting forwardly of the truck cab and directed downwardly therefrom in orientation overlying a road surface, and an impeller drive positioned within the chute adjacent the road surface, and a cogged conveyor belt positioned within and mounted for movement within the chute where the conveyor belt defines an elongate flight where a lower end of the flight positioned adjacent the impeller drive and upper end of the flightpositioned adjacent an upper terminal end of the chute, and a plurality of first heater plates mounted within the receiver tank, the first heater plates including a forward terminal end and a rear terminal end, the forward terminal end positioned adjacent the conveyor belt, and wherein the conveyor belt includes a plurality of spaced parallel projections positioned coextensively about an upper surface of the conveyor belt and transversely thereof, and wherein a lower terminal end of the heater plates spaced from the forward terminal end of the heater plates is positioned downwardly from the forward terminal end of the heater plates to direct fluid along the heater plates into the receiver tank, and the heater plates are arranged parallel relative to one another, and wherein the truck bed housing includes an auxiliary pump for directing fluid from the receiver tank outwardly therefrom, and including a drain pipe mounted to the receiver tank to permit selective drainage of the receiver tank, and a power unit mounted within the truck bed housing, and an electrical generator positioned within the truck bed housing, and a heater assembly positioned within the truck bed housing rearwardly of the power unit and the electrical generator, wherein the generator directing electrical energy to the heater assembly and the auxiliary pump, and wherein the heater assembly includes a plurality of spaced parallel second heater plates, wherein the heater plates are arranged coextensively relative to one another, and the heater assembly includes a housing in surrounding relationship relative to the heater plate, and the housing overlying the truck frame plate adjacent a rear terminal end of the truck frame plate, and the heater housing overlying a matrix of apertures, and a plurality of fan assemblies overlying the housing, and the fan assemblies arranged for directing heated air currents through the apertures into the underlying road surface for effecting melting and drying of the underlying road surface.

2. Apparatus as set forth in claim 1 including a first drive motor to effect selective rotation of the impeller drive, and a second drive motor to effect selective rotation of the conveyor belt.

* * * * *